US005590861A

United States Patent [19]

Ardolino

[11] Patent Number: 5,590,861

[45] Date of Patent: Jan. 7, 1997

[54] CUP HOLDER WITH A SPILL-COLLECTING PLATE

[76] Inventor: Sam Ardolino, 281 Kings Rd., Madison, N.J. 07940

[21] Appl. No.: 336,913

[22] Filed: Nov. 10, 1994

[51] Int. Cl.[6] ..... A47G 23/02

[52] U.S. Cl. ..... 248/146; 248/154; 248/311.2

[58] Field of Search ..... 248/146, 154, 248/311.2, 313, 346.11; D7/619, 624

[56] References Cited

U.S. PATENT DOCUMENTS

| | | | |
|---|---|---|---|
| 2,574,638 | 11/1951 | Gilbert | D7/624 X |
| 2,933,280 | 4/1960 | Hard | 248/154 X |
| 3,491,976 | 1/1970 | Larson | 248/346.11 |
| 4,089,498 | 5/1978 | Woodruff | 248/346.11 |
| 4,606,523 | 8/1986 | Statz et al. | 248/311.2 |
| 4,779,831 | 10/1988 | Anderson | 248/311.2 |
| 5,390,887 | 2/1995 | Campbell | 248/146 X |
| 5,398,898 | 3/1995 | Bever | 248/311.2 |

*Primary Examiner*—Derek J. Berger

[57] ABSTRACT

The present invention relates to a cup holder. This cup holder has a spill-collecting plate which includes a support ring formed of a relatively rigid plastic material of limited resilient capabilities. This ring is formed essentially in a circle with an opening along one extent thereof to allow for expansion and retraction. The holder further includes a base plate having a central extent of a circular configuration with an upstanding peripheral side wall. This base plate is fabricated of a relatively rigid elastomeric material. The side walls of this base plate are of a sufficient size to retain upon its upper surface any liquid spilled therein. The cup holder also employs a plurality of upstanding legs. These legs include a central leg which is coupled at its upper end to the lower edge of the ring at a location diametrically opposed from the opening, the legs also include supplemental legs having their upper ends coupled to the lower edge of the ring and their lower edges coupled to the upper face of the plate. Thus, the legs are in a vertical orientation equally spaced around the periphery of the ring. Each of the legs is made of a relatively rigid elastomeric material which allows for limited resilience.

1 Claim, 3 Drawing Sheets

PRIOR ART

CUP HOLDER WITH A SPILL-COLLECTING PLATE

BACKGROUND OF THE INVENTION

1. Field of the Invention

The present invention relates to a cup holder with a spill-collecting plate and more particularly pertains to precluding damage to tables, tablecloths, clothes and the like through the inadvertent spilling of coffee from a cup.

2. Description of the Prior Art

The use of coffee cup holders, coasters, saucers and the like is known in the prior art. More specifically, coffee cup holders, coasters, saucers and the like of various designs and configurations heretofore devised and utilized for the purpose of abating damage from the spilling of coffee through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,029,720 a combined cup and holder.

U.S. Pat. No. 5,110,170 discloses a combination plate and cup holding apparatus.

U.S. Pat. No. 5,118,014 discloses a spill-proof mug.

U.S. Pat. No. 5,249,700 discloses an interfitting plate and cup.

U.S. Pat. No. Des. 328,223 discloses the design of a combined drink cup holder and support.

In this respect, the cup holder with a spill-collecting plate according to the present invention substantially departs from the conventional concepts and designs of the prior art, and in doing so provides an apparatus primarily developed for the purpose of precluding damage to tables, tablecloths, clothes and the like through the inadvertent spilling of coffee from a cup.

Therefore, it can be appreciated that there exists a continuing need for a new and improved cup holder with a spill-collecting plate which can be used to preclude damage to tables, tablecloths, clothes and the like through the inadvertent spilling of coffee from a cup. In this regard, the present invention substantially fulfills this need.

SUMMARY OF THE INVENTION

In view of the foregoing disadvantages inherent in the known types of coffee cup holders, coasters, saucers and the like now present in the prior art, the present invention provides an improved cup holder with a spill-collecting plate. As such, the general purpose of the present invention, which will be described subsequently in greater detail, is to provide a new and improved cup holder with a spill-collecting plate and method which has all the advantages of the prior art and none of the disadvantages.

To attain this, the present invention essentially comprises a new and improved cup holder with a spill-collecting plate comprising, in combination, a support ring formed of a relatively rigid plastic material with limited resilient capabilities, the ring being formed essentially in a circle with an opening along one extent thereof for constituting less than ten percent of the circle to allow for expansion and retraction of the remainder of the ring, the ring having a cylindrical side wall with an interior surface and an exterior surface of an extended width and with an upper edge and lower edge of limited length equal to about fifty percent of the height; a base plate having a central extent in a circular configuration with an upstanding peripheral side wall, the base plate being fabricated of a relatively rigid elastomeric material, the side walls being sufficiently to retain on the upper surface of the base plate liquid spilled therein; three upstanding legs, the legs each having upper ends and lower ends, the legs including a central leg coupled at its upper end to the lower edge of the ring at a location diametrically opposed from the opening, the legs also including a pair of supplemental legs having their upper ends coupled to the lower edge of the ring and their lower edge coupled to the upper face of the plate whereby the legs are in a vertical orientation equally spaced 120 degrees around the periphery of the ring, the legs being made of a relatively rigid elastomeric material with limited resilience; and an elastomeric pad with a circular configuration secured to the lower surface of the dish to preclude inadvertent slipping thereof during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cup holder with a spill-collecting plate which has all the advantages of the prior art coffee cup holders, coasters, saucers and the like and none of the disadvantages.

It is another object of the present invention to provide a new and improved cup holder with a spill-collecting plate which may be easily and efficiently manufactured and marketed.

It is a further object of the present invention to provide a new and improved cup holder with a spill-collecting plate which is of durable and reliable constructions.

An even further object of the present invention is to provide a new and improved cup holder with a spill-collecting plate which is susceptible of a low cost of manufacture with regard to both materials and labor, and which accordingly is then susceptible of low prices of sale to the consuming public, thereby making such a cup holder with a spill-collecting plate economically available to the buying public.

Still yet another object of the present invention is to provide a new and improved cup holder with a spill-collecting plate which provides in the apparatuses and methods of the prior art some of the advantages thereof, while simultaneously overcoming some of the disadvantages normally associated therewith.

Still another object of the present invention is to preclude damage to tables, tablecloths, clothes and the like through the inadvertent spilling of coffee from a cup.

Lastly, it is an object of the present invention to provide a new and improved cup holder with a spill-collecting plate comprising a cup holder with a spill-collecting plate comprising a support ring formed of a relatively rigid plastic material with limited resilient capabilities, the ring being formed essentially in a circle with an opening along one extent thereof to allow for expansion and retraction of the remainder of the ring, the ring having a cylindrical side wall with an interior surface and an exterior surface of an extended length; a base plate having a central extent in a circular configuration with an upstanding peripheral side wall, the base plate being fabricated of a relatively rigid elastomeric material, the side walls being sufficiently to retain on the upper surface of the base plate liquid spilled therein; and a plurality of upstanding legs, the legs each having upper ends and lower ends, the legs including a central leg coupled at its upper end to the lower edge of the ring at a location diametrically opposed from the opening, the legs also including supplemental legs having their upper ends coupled to the lower edge of the ring and their lower edge coupled to the upper face of the plate whereby the legs are in a vertical orientation equally spaced around the periphery of the ring, the legs being made of a relatively rigid elastomeric material with limited resilience.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
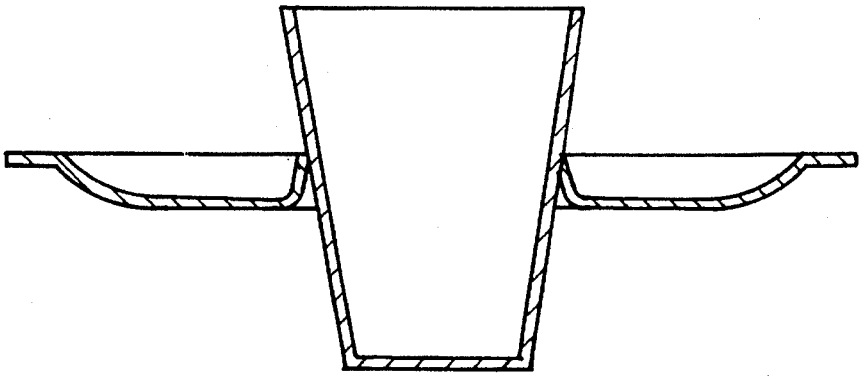
FIG. 1 is a cross-sectional view of a coffee cup holder constructed in accordance with a prior art design.
Figure 2:
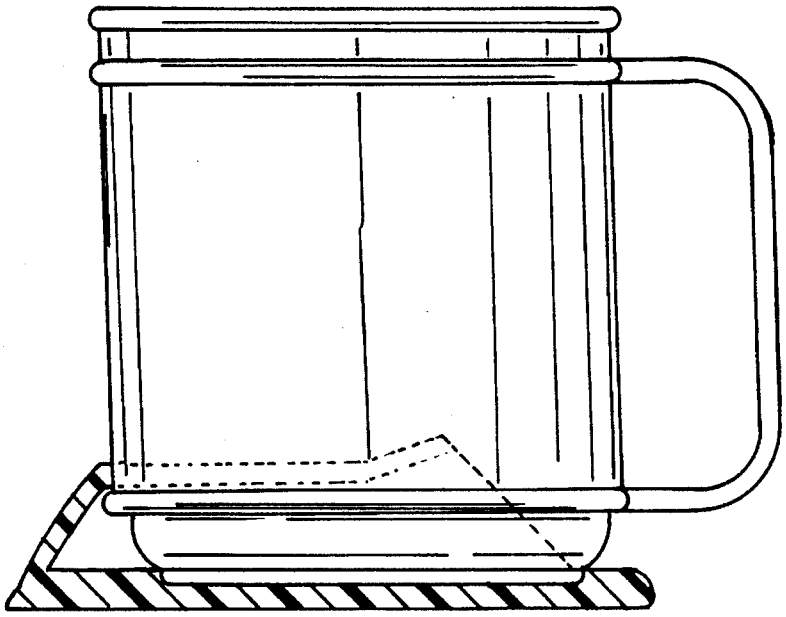
PRIOR ART Fig. 2
FIG. 2 is a cross-sectional view of a holder of yet another prior art design.
Figure 3:
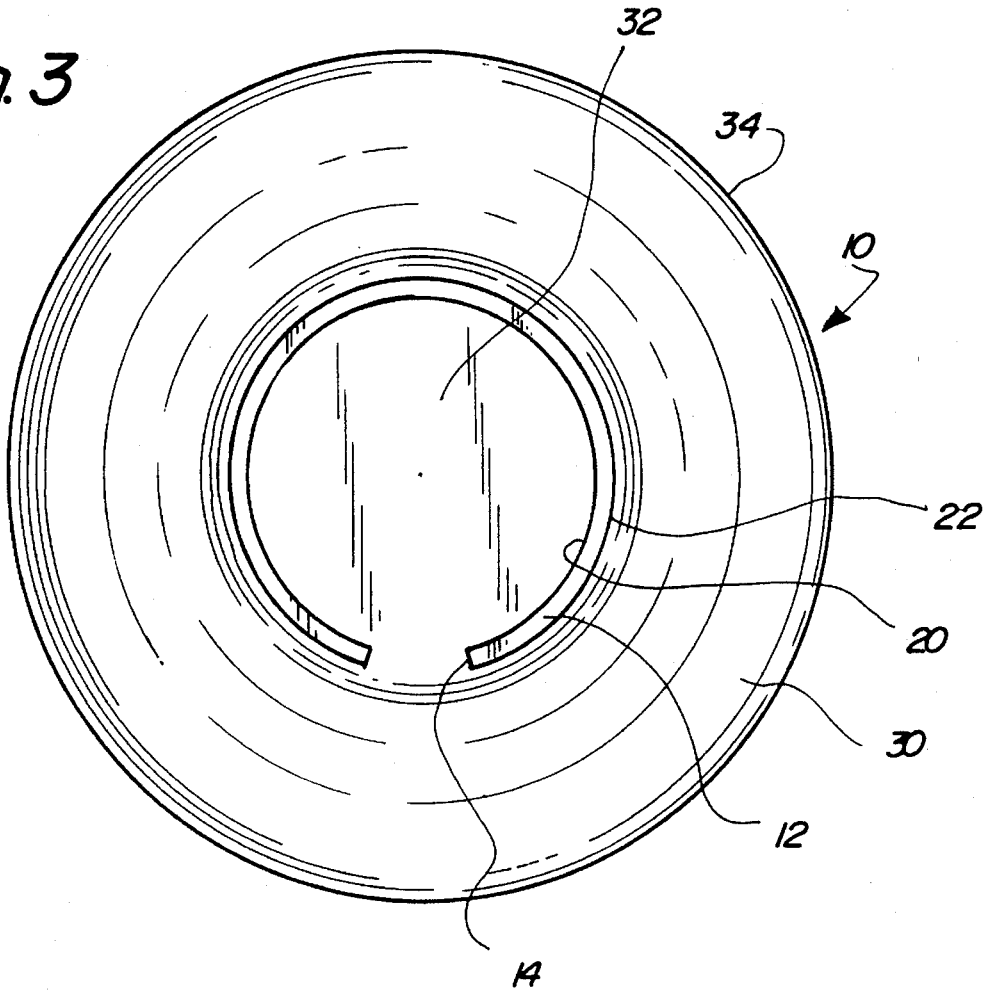
FIG. 3 is a top elevational view of the preferred embodiment of the new and improved cup holder with a spill-collecting plate constructed in accordance with the principles of the present invention.
Figure 4:
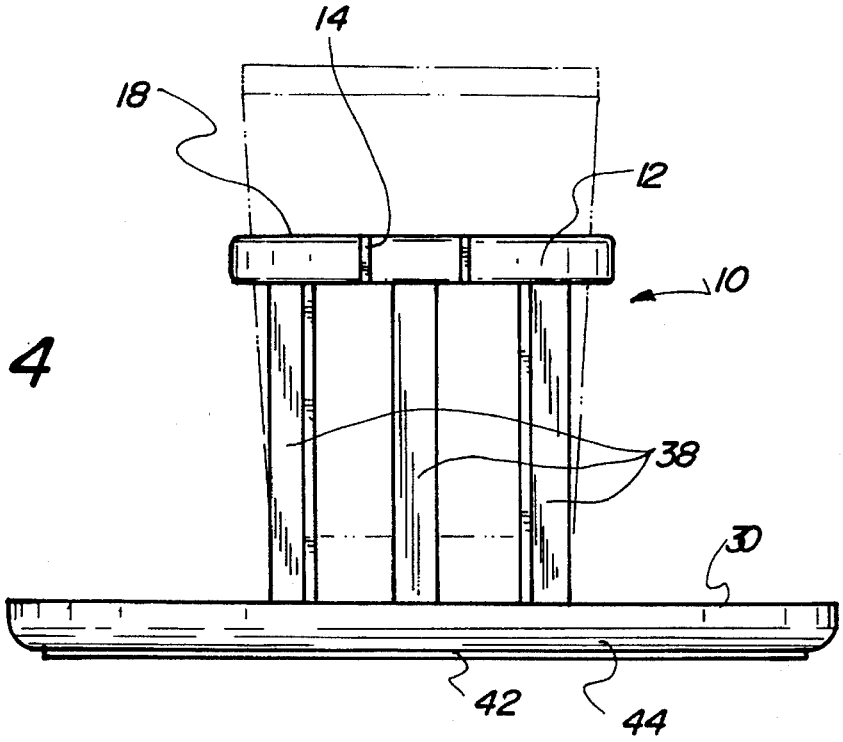
FIG. 4 is a side elevational view of the device shown in FIG. 3.
Figure 5:
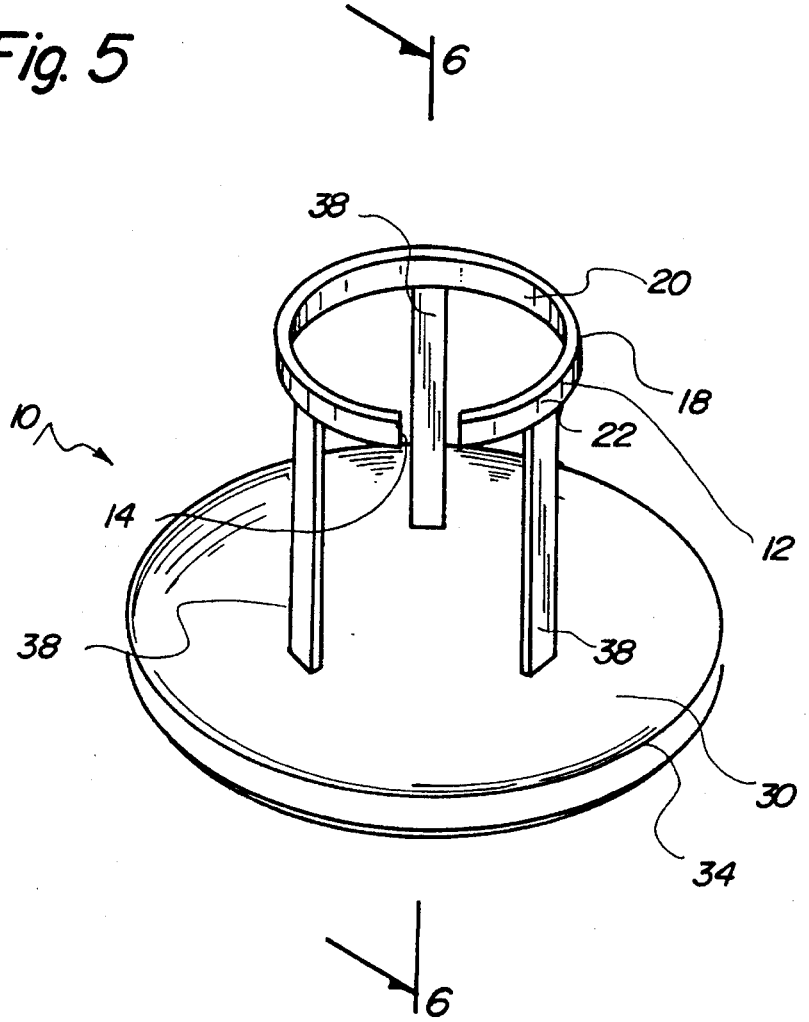
FIG. 5 is a perspective illustration of the device shown in FIGS. 3 and 4.
Figure 6:
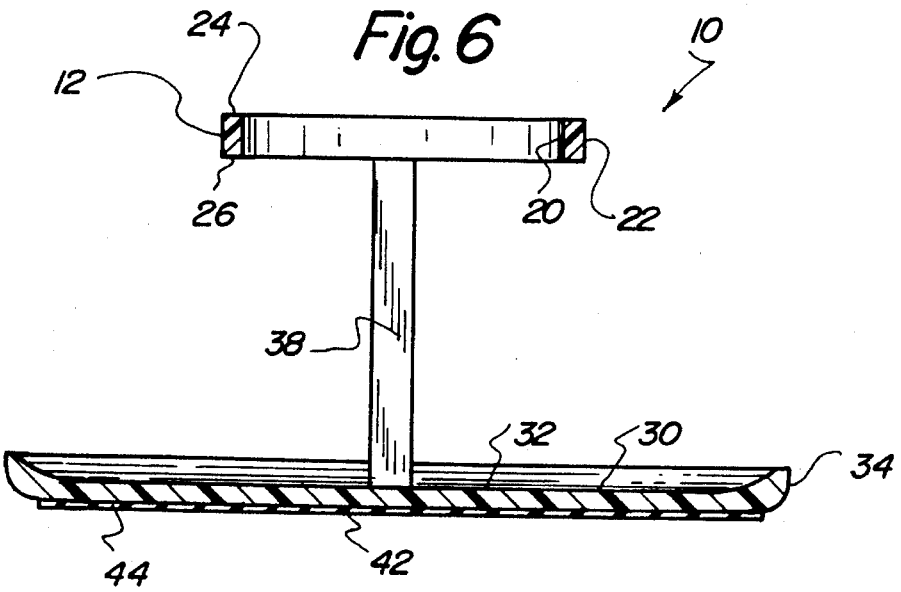
FIG. 6 is a cross-sectional view taken along line 6—6 of FIG. 5.

With reference now to the drawings, and in particular to FIG. 5 thereof, the preferred embodiment of the new and improved cup holder with a spill-collecting plate embodying the principles and concepts of the present invention and generally designated by the reference numeral 10 will be described.

The present invention, the new and improved cup holder with a spill-collecting plate, is a system 10 comprised of a plurality of components. The components, in their broadest context, include a support ring, a base plate, upstanding legs and an elastomeric pad. Such components are individually configured and correlated with respect to each other so as to attain the desired objective.

The present invention, the new and improved cup holder with a spill-collecting plate, is a system 10. A central component of such system is a support ring 12. The support ring is formed of a relatively rigid plastic material. It does, however, preferably have limited resilient capabilities. The ring is formed in an essentially circular configuration. It is formed with an opening 14 along one extent thereof. Such opening constitutes less than about ten percent of the circle. This allows for the expansion and retraction of the remainder of the ring.

The ring has a cylindrical side wall 18. Such side wall has an interior surface 20 and an exterior surface 22. It is of an extended length. It has an upper edge 24 and a lower edge 26. The width thereof is equal to about fifty percent of the height, between about forty-five and fifty-five has been found acceptable.

Next provided is a base plate 30. The base plate has a central extent 32. It is formed in a circular configuration. The base plate has an upstanding peripheral side wall 34. The base plate is fabricated of a relatively rigid elastomeric material. The side walls are of sufficient size and strength to retain on the upper surface of the base plate any liquid which might be spilled thereon during operation and use.

Next provided are a plurality of legs 38. The legs in the preferred embodiment are three in number. The legs each have upper ends and lower ends. The legs also include a central leg coupled at its upper end to the lower edge of the ring. Such is at a location diametrically opposed from the opening. The legs also include a pair of supplemental legs having their upper ends coupled to the lower edge of the ring and their lower edge coupled to the upper face of the plate. In this manner, the legs are vertically oriented and equally spaced about 120 degrees around the periphery of the ring. The legs are preferably fabricated of a relatively rigid elastomeric material. And like the other components of the system, preferably have a limited resilience.

Lastly provided in the system 10 is an elastomeric pad 42. Such pad is in a circular configuration. It is secured to the lower surface 44 of the dish. The function of the pad is to preclude inadvertent slipping of the system during operation and use.

The present invention comprises a cup holder which reduces spills and prevents soiling the floor, your shirt, or important papers.

The present invention is an injected molded plastic piece which resembles a shallow dish with a frame attached to it to hold a cup. The dish is about seven inches in diameter with a one-half inch high lip around its circumference. In the middle of the dish stands the frame or cage for the coffee cup. The cage is comprised of a ring with a four-inch inside diameter that is attached to the dish by means of three legs. These legs are 2-½ inches long and about ⅛ inch thick, and are equally spaced around the circumference of the ring. This ring is not actually a full 360 degrees but has an opening of one inch centered between two of the legs, allowing the cup's handle to pass through. A ⅛ inch rubber pad is glued to the bottom of the dish to add stability and prevent the unit from spilling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved cup holder with a spill-collecting plate comprising, in combination:

a support ring formed of a relatively rigid plastic material with limited resilient capabilities, the ring being formed essentially in a circle with an opening along one extent thereof for constituting less than ten percent of the circle to allow for expansion and retraction of the reminder of the ring the ring having a cylindrical side wall with an interior surface and an exterior surface of an extended length and with an upper edge and lower edge of limited width equal to about fifty percent of the height;

a dish shaped base plate having a central extent in a circular configuration with an upstanding peripheral side wall, the base plate being fabricated of a relatively rigid elastomeric material, the side walls being of a sufficient size to retain on the upper surface of the base plate liquid spilled therein;

three upstanding legs, the legs each having upper ends and lower ends, the legs including a central leg coupled at its upper end to the lower edge of the ring at a location diametrically opposed from the opening, the legs also including a pair of supplemental legs having their upper ends coupled to the lower edge of the ring and their lower edge coupled to the upper face of the plate whereby the legs are in a vertical orientation equally spaced 120 degrees around the periphery of the ring, the legs being made of a relatively rigid elastomeric material with limited resilience; and an elastomeric pad with a circular configuration secured to the lower surface of the dish to preclude inadvertent slipping thereof during operation and use.

* * * * *